US005758586A

United States Patent [19]

Kieser et al.

[11] Patent Number: 5,758,586

[45] Date of Patent: Jun. 2, 1998

[54] ADJUSTABLE HEIGHT TABLE

[76] Inventors: Joyce R. Kieser; H. Samuel Kieser, both of 46 Fox Den Rd., W. Simsbury, Conn. 06092

[21] Appl. No.: 781,528

[22] Filed: Jan. 9, 1997

[51] Int. Cl.[6] ..... A47B 9/00

[52] U.S. Cl. ..... 108/147; 108/144.11

[58] Field of Search ..... 108/147, 144, 108/12, 161; 248/188.2, 188.1, 161, 159, 157; 297/256.11, 338

[56] References Cited

U.S. PATENT DOCUMENTS

| | | | |
|---|---|---|---|
| 1,030,658 | 6/1912 | Gregory | 248/188.2 |
| 1,723,892 | 8/1929 | Schonberger | 248/159 X |
| 1,878,765 | 9/1932 | Ehrlich | 248/159 |
| 3,232,253 | 2/1966 | Winters | 248/188.2 X |
| 4,779,540 | 10/1988 | Dion et al. | 108/98 |
| 5,230,290 | 7/1993 | Crossman | 108/144 |
| 5,549,053 | 8/1996 | Grout | 108/144 X |
| 5,601,037 | 2/1997 | Meyer et al. | 108/144 X |

*Primary Examiner*—José V. Chen
*Attorney, Agent, or Firm*—H. Samuel Kieser

[57] ABSTRACT

An adjustable height table which comprises a table top having an upper work surface. The table includes at least one leg supporting said table top, the leg including a main leg segment. At least one removable leg segment is provided for insertion between the main leg segment and said table top. A connection between said table top and each said main leg portion clamps the removable leg segment between the table top and the main leg segment. The removable leg segment and the main leg segment present the profile of a continuous one-piece leg when said table top is clamped thereto.

23 Claims, 7 Drawing Sheets

ADJUSTABLE HEIGHT TABLE

BACKGROUND OF THE INVENTION

1. Field of the Invention

This invention relates generally to an adjustable height table. More particularly, this invention relates to a table having a work surface that is vertically adjustable to vary its height.

2. Background

The availability of portable computers such as laptops and notebooks has resulted in many people using such computers at home or while traveling and away from their office, either as an extension of their employment duties or for their own use. As such computers are small and readily portable, there is no need for a desk to be dedicated as a work site to contain the computer and peripheral equipment. Such computers may be used anywhere in the house, from dinning rooms, bedrooms and kitchens, to living rooms, libraries, recreation rooms and dens. While traveling, they may need to be used in a hotel or motel room.

With the portability of such computers, and their use out of a pure office environment, they are commonly used on an available surface, such as a kitchen or dining room table, a card table, coffee table, or simply placed in the user's lap. As a result, the computer is not necessarily at a height that is comfortable to the user, when considering the available seating and the user's height. The extended use of the laptop at an improper height, or when tenuously balanced, may result in user fatigue.

Although adjustable computer furniture is known, such furniture is usually very sterile in appearance and does not add to, or blend with, the decor of the room in which it is located. Additionally, such furniture does not readily lend itself to other uses such as end tables, sofa tables or the like.

SUMMARY OF THE INVENTION

In view of the above, it is an object of the present invention to provide an improved table in which the height of the table top or work surface may be adjusted.

Another object of the present invention is the provision of a table that is adjustable in height, but which presents the appearance of a regular piece of furniture, regardless of the height at which it is adjusted.

Yet another object of the present invention is the provision of an adjustable table the height of which may be easily adjusted without the need for tools.

A further object of the present invention is the provision of a table that is adjustable in height and which is convenient for supporting a laptop or notebook computer.

A still further object of the present invention is the provision of a table that is adjustable in height and which is convenient for supporting a laptop or notebook computer, but which may be used for other purposes.

Yet a still further object of the present invention is the provision of an improved table having a table top or work surface which is adjustable in height and which may be constructed so it can be easily moved from location to location.

These and other objects of the present invention may be achieved in accordance with the present invention through the provision of an adjustable height table which comprises a table top having an upper work surface and at least one leg supporting the table top, the leg including a main leg segment. At least one removable leg segment is provided for insertion between the main leg segment and the table top. A connection between the table top and the main leg segment raises and lowers the table top relative to the main leg segment and clamps the removable leg segment between the table top and the main leg segment, the removable leg segment and main leg segment presenting the profile of a continuous one-piece leg when the table top is clamped thereto.

BRIEF DESCRIPTION OF THE DRAWINGS

The present invention may be better understood by reference to the following detailed description and to the accompanying drawings in which.

DETAILED DESCRIPTION

Figure 1:
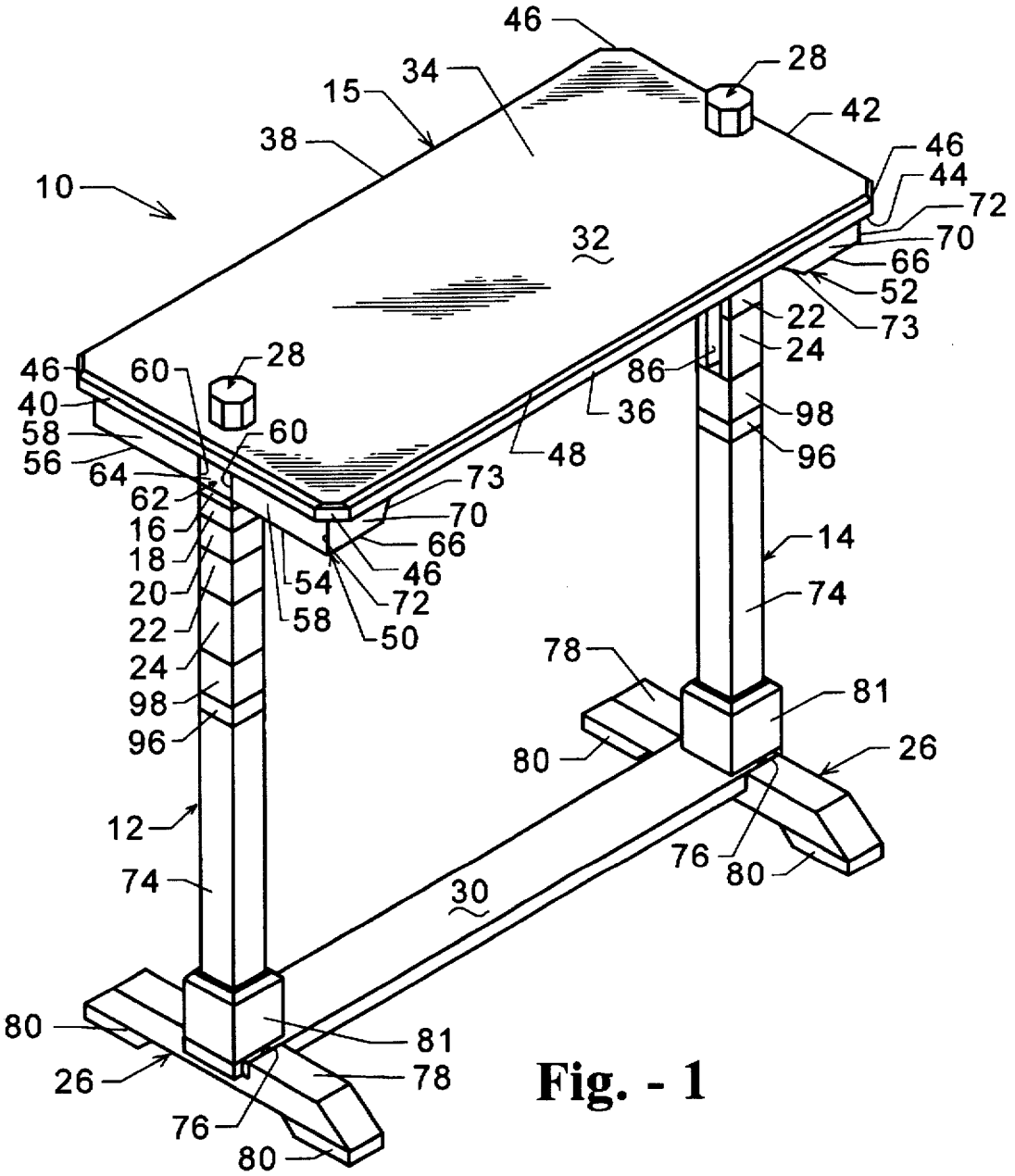
FIG. 1 is an isometric view of a table constructed in accordance with the present invention.

Referring to the drawings, and particularly FIG. 1, a table 10 embodying the principles of the present invention may include a left-hand leg or vertical support member 12, a right-hand leg or vertical support member 14, and a table top or work surface 15 connected to and supported by the two legs 12 and 14. Each leg 12 and 14 includes a plurality of height adjusting removable leg segments 16, 18, 20, 22 and 24 and terminates at its lower end in a foot 26. A knob 28 is associated with each leg 12 and 14 for tightening the table top 15 to a respective leg 12 or 14. A crossbar 30 extends between the two legs 12 and 14 adjacent the bottom of the table 10 as shown. Preferably, the table top 15, legs 12 and 14 and the crossbar 30 are fabricated from wood, such as the common furniture woods oak, maple, cherry, mahogany or the like, which permits a wide range of finishing techniques to be applied to their surfaces.

More specifically, the table top or work surface 15 comprises an elongated main member 32 having a planar top surface 34, a front surface 36, a rear surface 38, two opposed end surfaces 40 and 42, and a bottom surface 44. The corners of the main member 32 of the table top 15 may be angled as indicated at 46 or rounded or otherwise profiled to provide a decorative appearance. Additionally, the upper edge 48 of the main member 32 of the table top 15 may be chamfered as shown, or rounded or otherwise provided with a shaped edge portion, to also add to the decorative appearance of the table 10. Although the main member 32 has been shown as being generally rectangular, the member 32 may assume a variety of shapes such as oval, kidney-shaped, dog-boned or the like.

The table top 15 may include a left and right apron 50 and 52 extending downward from the bottom surface 44 of the main member 32 of the table top 15. Each apron 50 and 52 includes two generally rectangular members 54 and 56 having a planar outer surface 58 extending generally parallel to their respective end surface 40 or 42 of the main member 32. The upper surface of each member 54 and 56 is attached to the bottom surface 44 of the main member 32 of the table top. The inner ends 60 of each member 54 and 56 are spaced apart to form a gap in which a fixed leg segment 62 is located. Each fixed leg segment 62 is secured to the bottom surface 44 of the main member 34 of the table top 15 with its outer surface 64 being planar and flush with the planar outer surface 58 of each of its associated rectangular members 54 and 56. The planer outer surfaces 58 of the members 54 and 56 and the planar outer surface 64 of each fixed leg segment 62 are parallel to and offset inwardly from their respective side edge 40 or 42 of the main member 32 of the table top 15.

Figure 2:
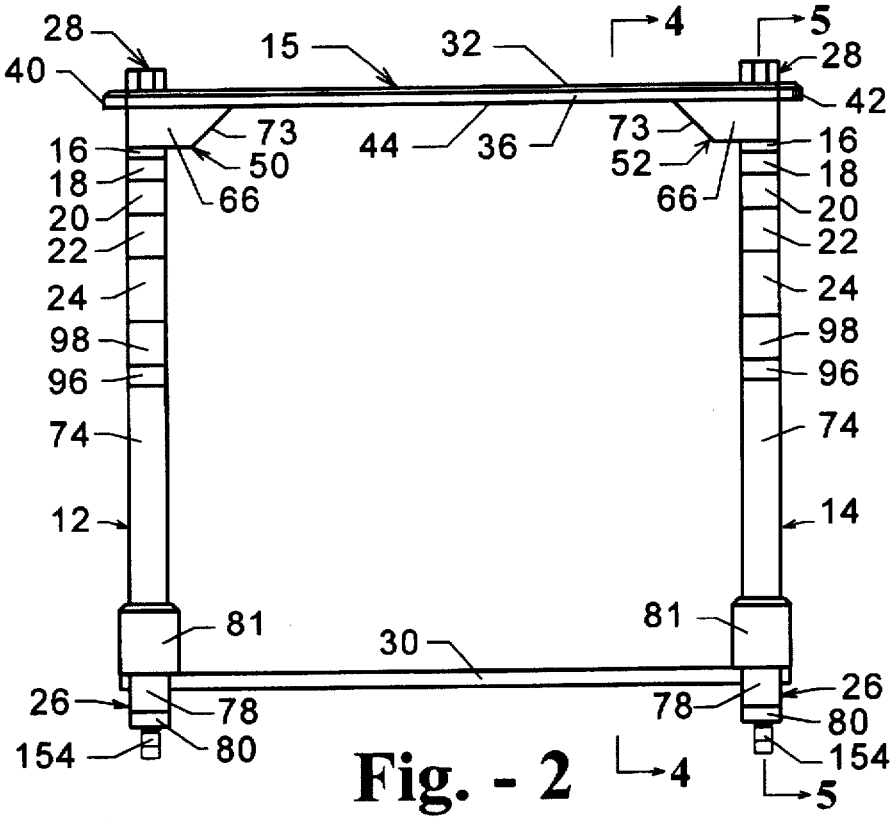
FIG. 2 is a front elevational view of the table of FIG. 1.
Figure 3:
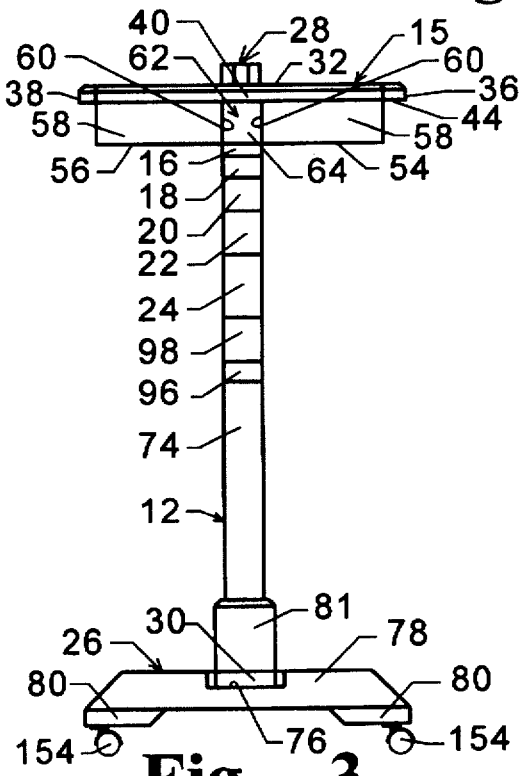
FIG. 3 is a side elevation of the table of FIG. 1.
Figure 4:
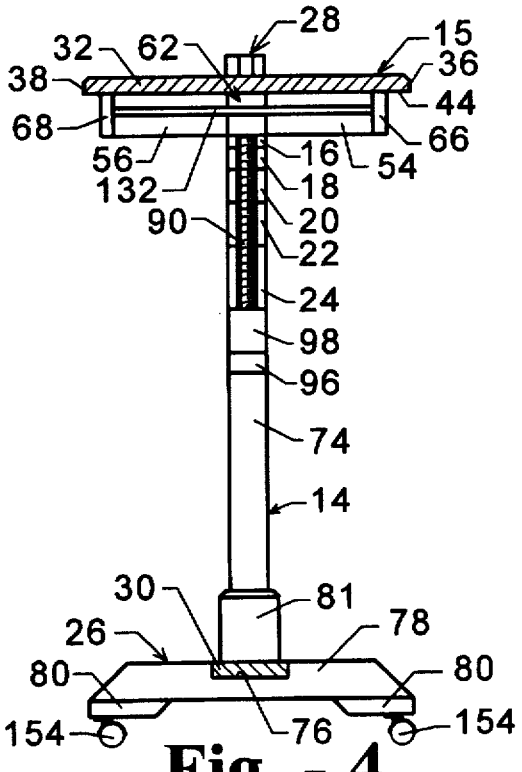
FIG. 4 is a vertical cross-sectional view taken along the lines 4—4 of FIG. 2.

Each apron 50 and 52 also includes a front and back member 66 and 68, each of which has an planar outer surface 70 extending parallel to and spaced inwardly from its associated front or rear surface 36 or 38 of the main member 32 of the table top 15 as shown. The upper surface of each of the front and back members 66 and 68 is attached to the bottom surface 44 of the main member 32 of the table top 15 with its outer end 72 adjacent a member 54 and 56 respectively abutting the end of that member 54 or 56 in a mitered or other appropriate type joint. The opposed inner ends 73 of the front members 66 and of the rear members 68 are spaced from each other to provide clearance under the main member 32 of the table top 15. The inner ends 73 of the members 66 and 68 may be tapered, or otherwise decoratively contoured or shaped, as shown in FIGS. 1 and 2.

Figure 5:
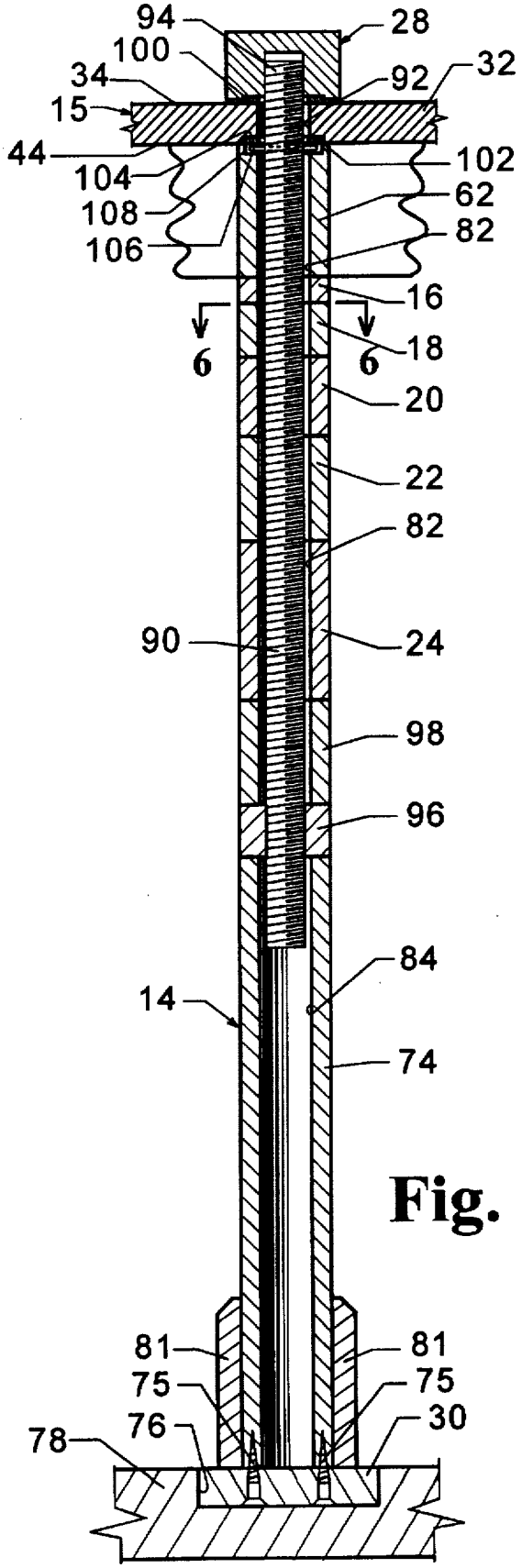
FIG. 5 is a partial vertical cross-sectional view taken along the lines 5—5 of FIG. 2.

Each leg 12 and 14 includes a main leg segment 74 separate from the fixed leg segment 62. As shown in FIG. 5, the bottom of each main leg 74 may be attached to the crossbar 30 by suitable fasteners such as screws 75 or the like as well as by glue. The crossbar 30 is in turn mounted in a groove 76 in each foot 26 and secured therein by gluing and, if desired, by screws (not shown) extending upward from the underside of each foot 26 into the crossbar 30. Alternatively, the legs 12 and 14, the crossbar 30 and feet 26 may be interconnected by any suitable woodworking technique as may be dictated by the overall design of those members.

Each foot 26 includes an elongated base member 78 having an axis of elongation extending transversely to the axis of the length of the table top 15. A footpad 80 extends downward from each base member 78 adjacent each end thereof. A molding 81 or other decorative panel may be attached to the outside surfaces of each main leg segment 74 at the bottom end thereof as shown for decorative purposes. Alternatively, such decoration may be accomplished my any other suitable woodworking technique.

Figure 6:
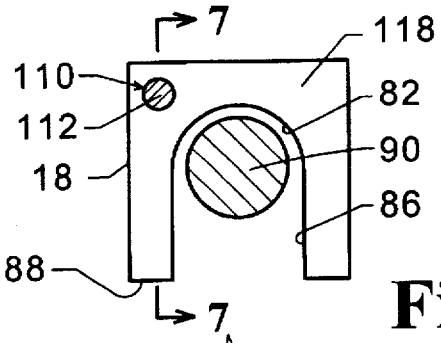
FIG. 6 is a horizontal cross-sectional view taken in the direction of lines 6—6 of FIG. 5.

Each of the fixed leg segments 62 and each of the removable leg segments 16, 18, 20, 22 and 24 have a bore 82 extending therethrough as shown most clearly in FIGS. 5 and 6. Each main leg segment 74 also includes an axial bore 84 extending through at least the upper portion thereof, although, as shown in the drawings, the bore 84 extends entirely through the main leg segment 74. As shown particularly in FIG. 6, each of the removable leg segments 16, 18, 20, 22 and 24 includes a cutout 86 in a side face 88 extending into the segment 16, 18, 20, 22 or 24 into communication with the bore 82. The width of the cutout 86 is substantially equal to the diameter of the bore 82 as shown.

As shown in FIG. 5, each leg 12 and 14 has a threaded rod 90 associated with it which extends downward through a bore 92 in the main member 32 of the table top 15. Preferably, the rod 90 is fabricated from wood, although other suitable materials such as plastic and metal may be used. Each threaded rod 90 extends through the bore 82 in the fixed leg segment 62, and through the bores 82 in the removable leg segments 16, 18, 20, 22 and 24 into the bore 84 in the main leg segment 74 of its respective leg 12 or 14. The upper end 94 of each rod 90 extends above the top surface 34 of the main member 32 of the table top 15 and is attached to its associated knob 28.

Each main leg segment 74 is provided with an internal threaded portion 96 into which the threaded rod 90 is threaded. The bore 84 in the main leg segment 74 receives the rod 90 for axial and rotational movement therebetween, and must be of at least a slightly greater diameter than the diameter of the rod 90.

As the normal manufacturing technique is to cut the treads into the rod 90, the minor diameter of the threads in the internal threaded portion 96 of the main leg segment 74 is necessarily smaller than the major diameter of the external threads on the rod 90. Accordingly, the minor diameter of the internal threaded portion 96 must be less than the diameter of the bore 84.

There are several methods of fabricating the legs 12 and 14. In the arrangement shown, each leg 12 and 14 is constructed from two pieces. Each piece should have an original length equal to the combined height of the fixed leg segment 62, the removable leg segments 16, 18, 20, 22 and 24, the main leg segment 74 and an additional amount to compensate for the material lost in sawing by the saw kerf. One section, equal to the height of the threaded portion 96, is cut from each piece. One face of each remaining piece may then be routed axially along its length to provide a cutout of a depth and width to form one-half of the bores 82 and 84. The routed faces of the two pieces may then be glued together to form one long section having the bores 82 and 84 extending axially therethrough. The various removable leg segments 16, 18, 20, 22 and 24 and the fixed leg segment 62 may then be cut from the glued piece, leaving a main leg portion. The two sections cut for the threaded portion may then be glued together, drilled and tapped to provide the internal threads of the threaded portion 96. The threaded portion 96 may then be affixed by glue to the top of the main leg portion. Alternatively, as shown in the drawings, the main leg segment 74 may have a guide portion 98 positioned above the threaded portion 96. This arrangement may be achieved by cutting a length for the guide portion 98 from the main leg portion and then gluing the threaded portion 96 between the guide portion 98 and the remaining main leg portion to form the main leg segment 74. Also, the routing of the original two pieces may terminate short of the bottom end of each piece so that the resulting main leg segment 74 is provided with a bore 84 which terminates short of the bottom surface.

Instead of fabricating the threaded portion as a separate section, the original two pieces of each leg 12 and 14 may have their surfaces routed in two sections leaving an unrouted section along the length at the point at which the threaded portion 96 is desired. After the two sections are glued together, and the removable leg segments 16, 18, 20, 22 and 24 and the fixed leg segment 62 are cut therefrom, the main leg segment 74 will have a solid cross-section at the location of the threaded portion 96 which may be drilled and tapped to provide the internal threads of the threaded potion 96. With this arrangement, the threaded portion 96 may be at the upper end of the main leg segment 74 or spaced downward therefrom to provide the guide portion 98. Also, the bore 84 may extend along the entire length of the main leg segment 74 (except for the threaded portion 96), or terminate at a point spaced from the bottom end to provide a solid portion at the bottom of the leg 12 or 14.

It is also possible to fabricate each leg 12 and 14 from one solid piece. This may be accomplished by cutting a solid piece for each leg 12 and 14 into two sections, one section of a length to form the fixed leg segment 62 and the removable leg segments 16, 18, 20, 22 and 24, and another length to form the main leg segment 74. The bore 82 in the section from which the fixed leg segment 62 and the removable leg segments 16, 18, 20, 22 and 24 are to be formed may be drilled axially in that section before that section is divided into its various segments, or the section may be cut into the various segments and each segment drilled individually to provide the bore 82. Depending upon the required length, the bore 84 in the section forming the main leg segment 74 may be drilled into the bottom end portion of that segment up to a point at which the threaded leg portion 96 is desired. A smaller diameter bore for the threaded leg portion 96 may then be drilled into the upper end and this smaller bore then tapped to provide the internal threads. If it is desired to provide the guide portion 98, a smaller diameter bore for the threaded portion 96 may first be drilled into the upper end of the section a sufficient distance to provide for the height of the guide portion 98 as well as the threaded portion 96. The upper end of the section may then be counter-bored to provide the bore 84 in the guide portion 98. If it is desired to provide a solid portion at the bottom of the main leg segment 74, a piece must be cut from the section forming the main leg segment 74 of a height equal to the threaded portion 96 which may be separately drilled and tapped to provide the internal threads. The remaining main leg segment piece may then be drilled from the top end the desired distance. The drilled and tapped threaded portion 96 may the be secured to the main leg section piece at the top thereof by gluing, or sandwiched between two pieces of the segment forming the main leg segment 74 to provide the guide portion 98.

The threaded rod 90 is attached to the table top 15 so that the rod 90 can rotate relative to the table top 15, but is prevented from axial movement therewith in a direction along the axis of the rod 90 so that the table top 15 will move vertically with the rod 90. As shown particularly in FIG. 5, the rod 90 extends through the bore 92 in the table top 15 with the knob 28 attached to its upper end 94. A washer 100, which may be of brass or other suitable material, is provided between the underside of the knob 28 and the top surface 34 of the table top 15. A bearing surface in the form of a metallic washer member 102, through which the rod 90 extends, is provided against the bottom surface 44 of the table top 15. The washer member 102 is preferably mounted in a counterbore 104 in the bottom surface 44 of the table top 15 which is co-axial with the bore 92. A metallic pin 106, of a length greater than the diameter of the opening of the washer member 102, extends transversely through the rod 90 immediately below the washer member 102.

The fixed leg segment 62 may be provided with a counterbore 108 in its upper end to provide clearance for the pin 106 while permitting the upper end surface of the fixed leg segment 62 to abut against, and be affixed as by glue, to the bottom surface 44 of the table top 15. This arrangement permits the rod 90 to rotate about its axis relative to the table top 15. However, axial movement of the rod 90 with respect to the table top 15 is constrained in one direction by the pin 106 contacting the metallic washer member 102, and in the other direction, by the knob 28, which is fixedly attached to the rod 90, and the washer 100 engaging the top surface 34 of the table top 15.

The individual removable leg segments 16, 18, 20, 22 and 24 have the cutout 86 in their inner surface so each segment 16, 18, 20, 22 and 24 can be maneuvered into position around the threaded rod 90 and removed therefrom. Since these segments 16, 18, 20, 22 and 24 are removable, they may be provided with aligning means 110 so that when inserted about the rod 90, they will assume the proper horizontal position with respect to each other and to the fixed leg segment 62 and the main leg segment 74. This will ensure that the upper and lower outer edges of each removable leg segment 16, 18, 20, 22 and 24 will be flush with the outer edges of each other and those of the main leg segment 74 and the fixed leg segment 62 so that the outer surface of each leg 12 and 14 presents a profile of a continuous one-piece leg. In the case of some leg designs however, the outer edges of adjacent surfaces of adjacent leg segments may not designed to be flush. However, even in this case, the leg segments when clamped between the table top 15 and the main leg segment 74 should provide the profile of a single member leg. This results in a table that is adjustable in height, but which has the appearance of a non-adjustable fixed height table.

Figure 7:
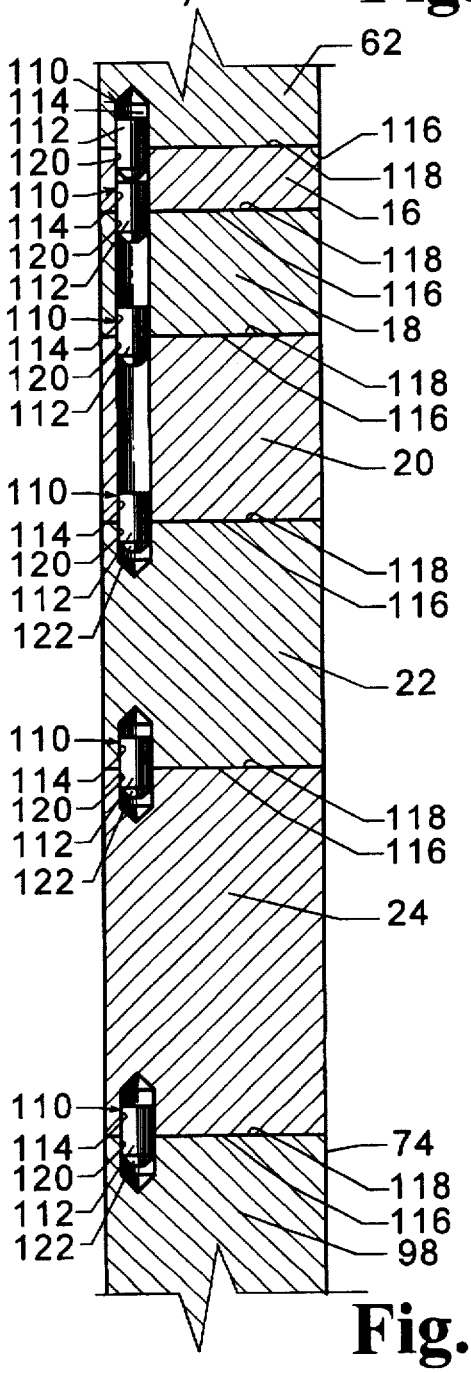
FIG. 7 is a partial vertical cross-sectional view of a leg of the table taken in the direction indicated by the lines 7—7 of FIG. 6.
Figure 8:
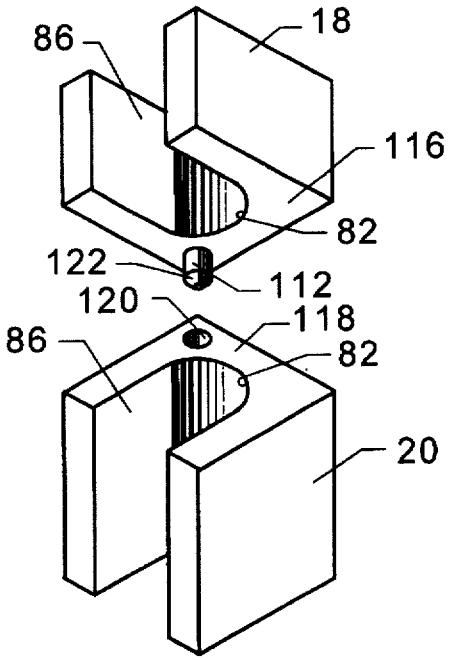
FIG. 8 is an isometric view of two adjacent removable leg segments, showing the bottom surface of the higher segment and the top surface of the lower segment.

The aligning means 110, as shown in FIGS. 6–8, may be in the form of wooden alignment pins or pegs 112 secured in a bore 114 in the bottom surface 116 of each removable leg segment 16, 18, 20, 22 and 24 and the fixed leg segment 62 as shown in FIG. 7. The upper surface 118 of each removable leg segment 16, 18, 20, 22 and 24 and the upper surface of the main leg segment 74 may be provided with a bore 120 to receive the pin 112 of an the leg segment. The pins 112 and bores 120 are in axial alignment so that the removable leg segments 16, 18, 20, 22 and 24 are properly aligned so that their outer surfaces present the appearance of a continuous one-piece leg. The bores 114 and 120 may be co-extensive as in the case of removable leg segments 16, 18 and 20, or separate as in the case of removable leg segments 22 and 24. The pins 112 may have their outer ends tapered or rounded as indicted at 122 in FIG. 7.

Figure 9:
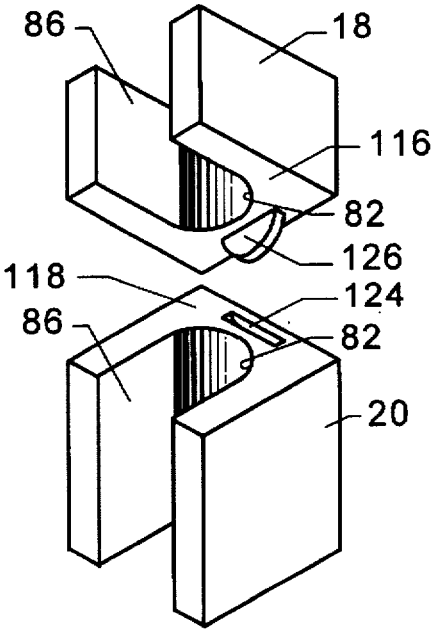
FIG. 9 is an isometric view similar to FIG. 8, but showing a modified form of the aligning means used for the removable leg segments.

An alternative arrangement for the aligning means 110 is shown in FIG. 9. In place of the pins 112 and mating bores 120, a tongue and groove arrangement may be used. As shown in FIG. 9, one such arrangement may include a groove 124 formed in the upper surface 118 of the each removable leg segment 16, 18, 20, 22 and 24, and also in the upper surface of the main leg segment 74. The bottom surface of each of the removable leg segments 16, 18, 20, 22 and 24, as well as the fixed leg segment 62, may be provided with a mating tongue 126 adapted to be received within the groove 124 of a adjacent segment 16, 18, 20, 22, 24 or 74.

Each tongue 126 may be a relatively thin circular or oval shaped biscuit-like member mounted in a suitable groove in the bottom 116 of each segment 16, 18, 20, 22 24 and 62. The groove 124 may be of a shape corresponding to the shape of the biscuit-like member which protrudes from the bottom 116, but slightly larger to provide a sliding fit. With this arrangement, when adjacent segments are positioned together, relative movement between the two adjacent segments is prevented, both movement in a horizontal plane, as well as rotational movement.

The table is shown in its highest position in FIGS. 1–7. In this position, all the removable leg segments 16, 18, 20, 22 and 24 of each leg 12 and 14 are positioned between the main leg segment 74 and the fixed leg segment 62. The threaded rod 90, associated with each leg 12 and 14, extends from the knob 28, through the bore 92 in the main member 32 of the table top 15, through the bore 82 in the fixed leg segment 62, through the bores 82 in the removable leg segments 16, 18, 20, 22 and 24 into the bore 84 in the main leg segment 74. Each knob 28 may be rotated about its axis to thread its associated rod 90 into the threaded portion 96 of their respective legs 12 and 14, thereby drawing the table top 15 toward each main leg segment 74 clamping the removable leg segments 16, 18, 20, 22 and 24 between the fixed leg segment 62 and the main leg segments 74. This provides stability of the table top 15 relative to the legs 12 and 14.

When it is desired to adjust the height of the table top 15 relative to the feet 26, each knob 28 may be rotated in a direction to withdraw the threaded rod 90 upwardly from the threaded portion 96 of its respective leg 12 or 14. As the table top is secured to the threaded rod 90 for axial movement therewith, the table top 15 and the fixed leg segments 62 will move upward, separating in distance from the main leg segments 74. At the point the table top 15 and fixed leg segments 62 have separated from the main leg segments 74 a distance sufficient to permit an individual removable leg segment 16, 18, 20, 22 or 24 to be separated from an adjacent segment, with its associated pin 112 or tongue 126 capable of being withdrawn from the bore 118 or groove 124 of an adjacent segment, one or more of the removable leg segments 16, 18, 20, 22 or 24 of each leg 12 and 14 of a thickness corresponding to amount by which it is desired to lower the table top 15 may be removed from its location the legs 12 and 14. Each knob 28 may then be rotated in the opposite direction to thread its associated threaded rod 90 into the threaded portion 96 of the main leg segment 74, thereby drawing the table top 15 down toward the main leg segment 74 and clamping the remaining removable leg segments, if any, between the fixed leg segment 62 and the main leg segment 74.

A similar procedure is employed to increase the height of the table top 15 when not all of the removable leg segments 16, 18, 20, 22 and 24 are already being employed. The knobs 28 are rotated in a direction to withdraw the threaded rod 90 upwardly from the threaded portion 96 of its respective leg 12 or 14, whereby the table top 15 and fixed leg segments 74 separate in distance from their associated main leg segment 74. The separation must be enough to provide a vertical space between a set of adjacent segments of a height at least slightly greater than the overall height of the removable leg segment or segments 16, 18, 20, 22 or 24 which are to be inserted. After the new removable leg segments or segments are positioned about the rod 90, the knobs 28 are rotated in the opposite direction to draw the table top 15 and fixed leg segment 62 down toward the fixed leg segment 74 and clamping the removable leg segments together.

As will be noted in the drawings, the height of each removable leg segment 16, 18, 20, 22 and 24 is different to provide for multiple heights with a minimum of removable leg segments. For example, for each leg 12 and 14, leg segment 16 may be ½ inch high, leg segment 18 may be 1 inch high, leg segment 20 may be 1½ inches high, leg segment 22 may be 2 inches high and leg segment 24 may be 3 inches high. This permits an overall height adjustment of the table top 15 of 8 inches in ½ inch intervals with five removable leg segments. As the removable leg segments 16, 18, 20, 22 and 24 are of different heights, when removing or adding removable leg segments from or to the legs 12 and 14, care must be taken that segments of the same height are removed from or added to each leg 12 and 14.

Alternatively, each of the removable leg segments 16, 18, 20, 22 and 24 may be of the same height. In this case, the height of each removable leg segment would be that of the smallest increment that the table could be raised or lowered. The number of individual removable leg segments required for each leg in this case would be the total amount of height adjustment divided by the height of an individual leg segment. It is to be understood that various combinations of sets of removable leg segments with the same height and sets of a different height may be used for each leg 12 and 14. Although the rod 90 has been shown threaded along its entire length, it will be recognized that the lower end portion need only be threaded over a length sufficient to ensure that a threaded portion of the rod 90 will be in engagement with the threaded portion 96 of the main leg segment 74 during the total necessary overall vertical rise of the table top 15 relative to the main leg segments 74.

Figure 10:
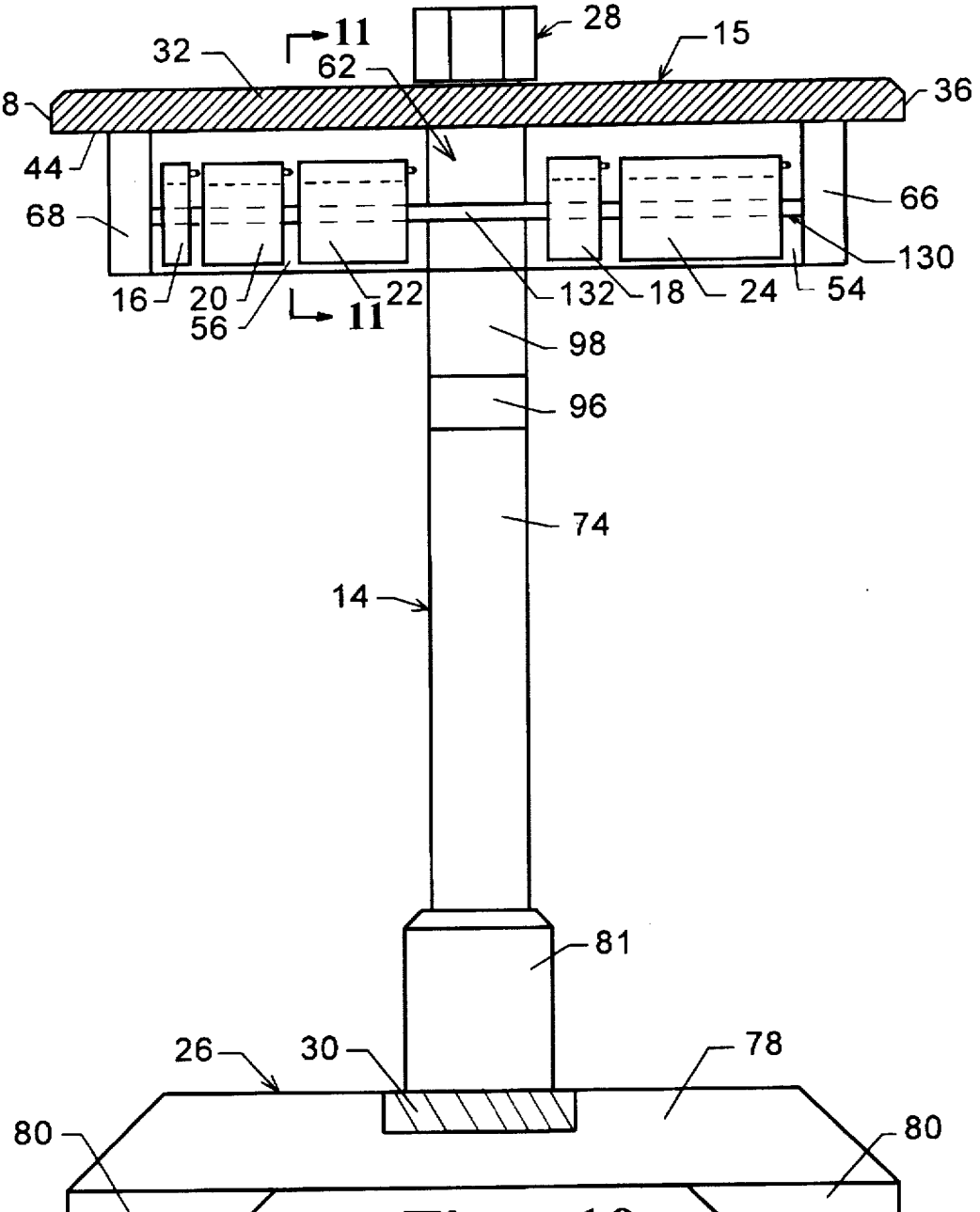
FIG. 10 is a vertical cross-sectional view of the table of FIG. 1 similar to FIG. 4, but showing the table top or work surface in its lowest position.
Figure 11:
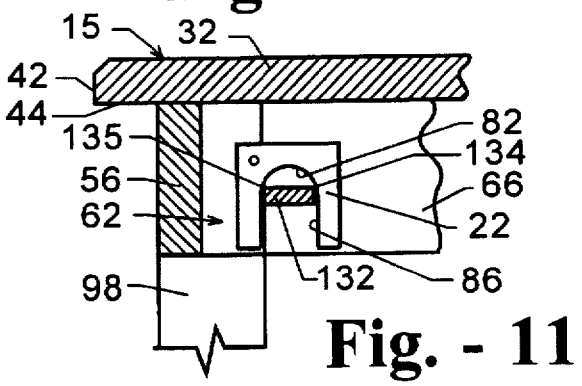
FIG. 11 is a partial vertical cross-sectional view taken along the lines 11—11 of FIG. 10.

The table 10 may be provided with a storage means or area 130 for storing and holding the removable leg segments 16, 18, 20, 22 and 24 with the table 10 when they are not in use. FIG. 10, which shows the table 10 in its lowermost position with all the removable leg segments 16, 18, 20, 22 and 24 removed from the legs 12 and 14, depicts one such storage means 130. A bar 132 may extend transversely of the table top 15 between the front and back members 66 and 68 of each apron 50 and 52 adjacent the fixed leg segment 62. The bar 132 is spaced downward from the bottom surface 44 of the main member 32 of the table top 15 and inwardly from the inner surface of the rectangular members 54 and 56 of the respective left and right aprons 50 and 52 a sufficient distance to permit a removable segment 16, 18, 20, 22 or 24 to be hung on the bar 132 as shown in FIGS. 10 and 11.

The removable leg segment 16, 18, 20, 22 or 24 may be inserted onto the bar 132 with the face 88 containing the cutout 86 facing the rectangular members 54 and 56 of the apron 50 or 52. The removable leg segment 16, 18, 20, 22 or 24 may then be rotated so that the opening of the cutout 86 is facing down as shown in FIG. 11. The use of a bar 132 having a generally rectangular cross-section with a width slightly less than the width of the cutout results in the removable leg segment 16, 18, 20, 22 or 24 resting in contact with the bar 132 at two points 134 and 135 of line contact rather than over a surface area of the bore 82 as would be the case if a cylindrical rod was used. This aids in preventing the removable leg segments 16, 18, 20, 22 and 24 from inadvertently rotating and slipping off the bar 132.

Figure 12:
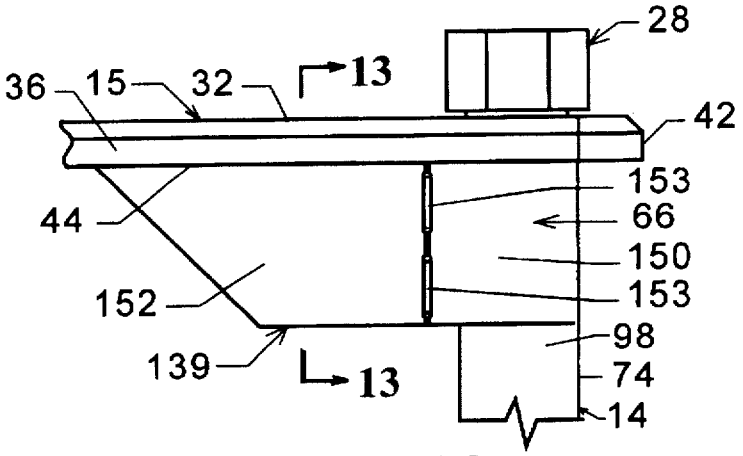
FIG. 12 is a partial front elevational view of the upper right portion of the table of FIG. 1 showing a modification thereto.
Figure 13:
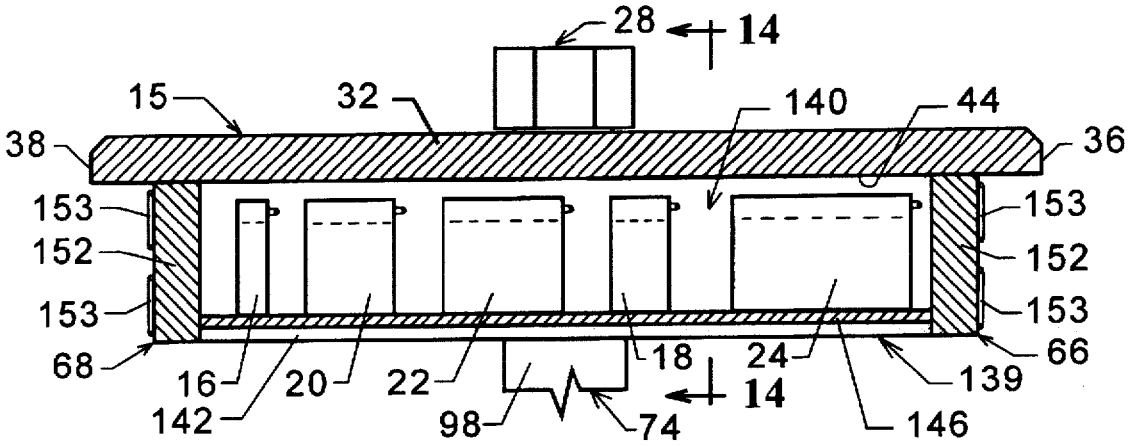
FIG. 13 is a vertical cross-section view taken along the lines 13—13 of FIG. 12 further showing the modified table of FIG. 12.
Figure 14:
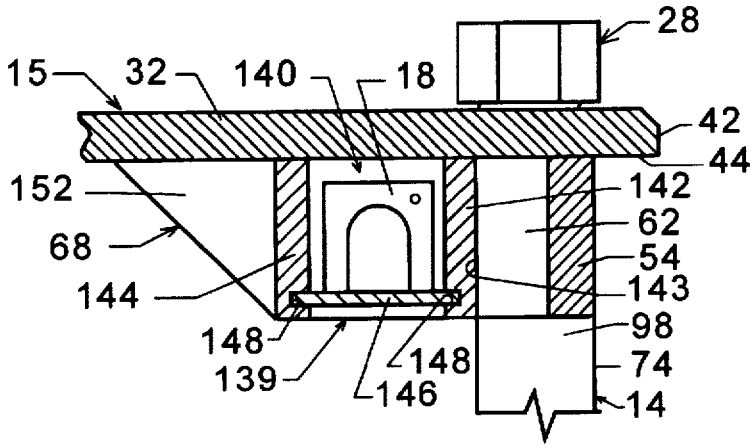
FIG. 14 is a vertical cross-section taken along the lines 14—14 of FIG. 13 showing further detail of the modification of FIG. 12.

An alternative storage means 139 for storing the removable leg segments is shown in FIGS. 12–14. According to this modification, the table 10 may be provided with storage compartments 140 underneath the main member 32 of the table top 15, one adjacent each end surface 40 and 42. Each compartment 140 may be formed by providing a first wall member 142 extending generally parallel to the rectangular members 54 and 56 of the apron 50 or 52 and spaced inwardly of the end surfaces 40 or 42 of the table top 32 against the inner surface 143 of the fixed leg segment 62. A second wall member 144 may be provided, parallel to the first wall member 142, and spaced inwardly therefrom. Both wall members 142 and 144 terminate at their front end at the front member 66 of the apron 50 or 52, and at their rearward end at the back member 68 of the apron 50 or 52. A base or floor member 146 extends the length of the wall members 142 and 144 and is mounted in slots 148 in each wall member 142 and 144 adjacent the bottom edge thereof as shown.

In the case of the embodiment of the storage means 139 shown in FIGS. 12–14, each front and back member 66 and 68 of the aprons 50 and 52 is formed from two members 150 and 152. The first member 150 is adjacent the end of the table 10 and has its upper surface connected to the bottom surface 44 of the main member 32 of the table top 15 and its outer side surface abutting the rectangular member 54 or 56 of the apron 50 or 52. The second member 152 is hinged to the first member 150 by suitable hinges 153 as shown and provides a door for the openings to the compartments 140. A suitable latch, not shown, may be provided to hold the second members 152 in their closed position. With this arrangement, the removable leg segments 16, 18, 20, 22 and 24, as well as other items, may be stored within the compartment 140 when not in use.

If desired, the table 10 may include castors or rollers 154 attached to the bottom of the footpads 80 of each foot 26 as shown in FIGS. 2–4 and 10. The castors 154 will aid in the mobility and maneuverability of the table 10.

Figure 16:
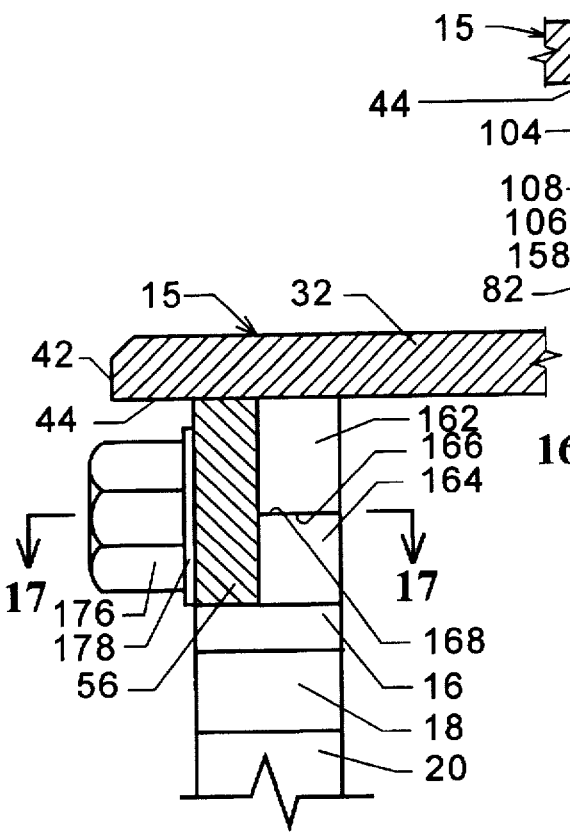
FIG. 16 is a partial vertical cross-section view taken along the lines 16—16 of FIG. 15.
Figure 17:
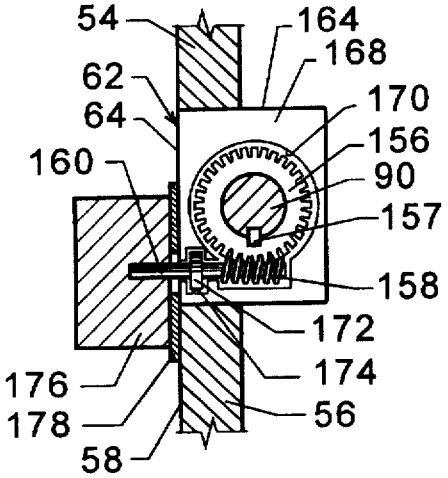
FIG. 17 is a partial horizontal cross-section view taken along the lines 17—17 of FIG. 16.
Figure 15:
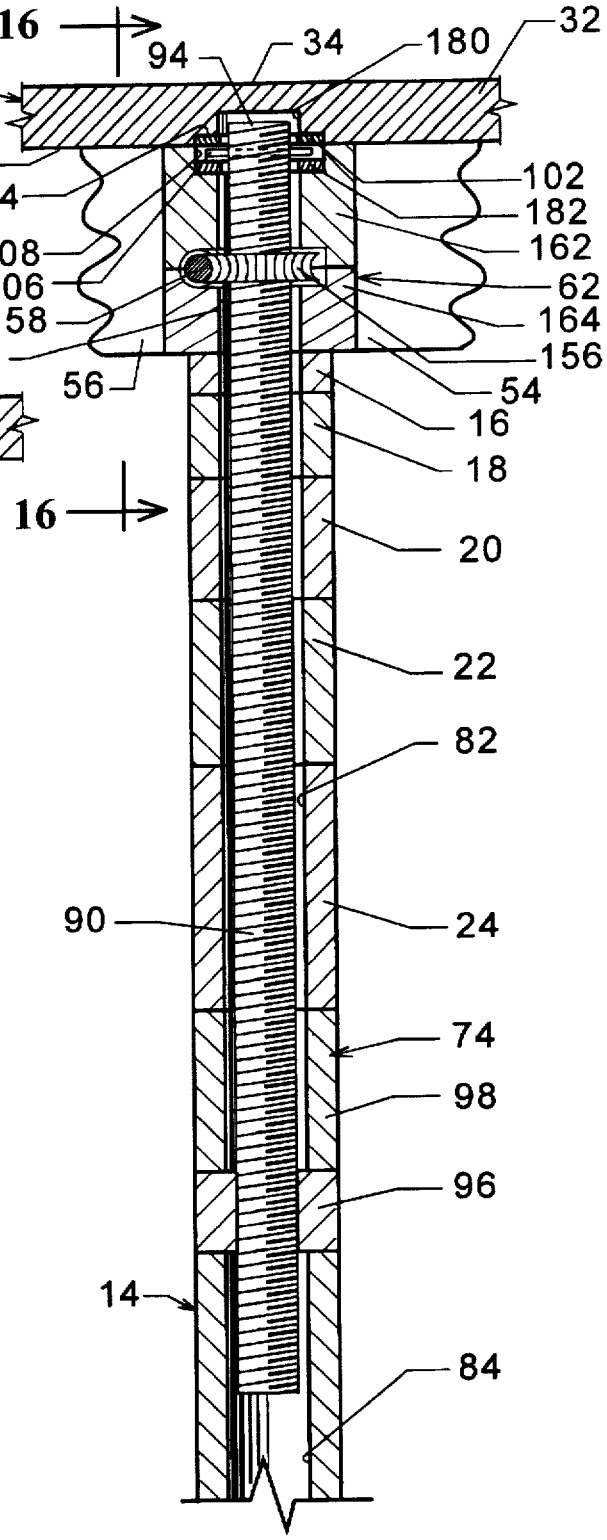
FIG. 15 is a vertical cross-sectional view similar to FIG. 5, but showing a further modification of the table of the present invention.

An alternative means for raising the table top 15 and fixed leg segment 62 relative to the main leg segment 74 is shown in FIGS. 15–17. According to this embodiment, a worm wheel 156 is fixedly attached to the rod 90 in the region of the fixed leg segment 62 by a key member 157 or the like. A worm 158, attached to a spindle or shaft 160, extends in a horizontal plane at a right angle to the axis of the rod 90 and worm wheel 156, and is in engagement with the worm wheel 156 to form a worm gear mechanism.

The fixed leg segment 62 in this embodiment is split into an upper and lower component 162 and 164, with the bottom surface 166 of the upper component 162 and the upper surface 168 of the lower component 164 provided with a recess or cut out 170 to house the worm wheel 156 and worm 158 and spindle 160. A collar 172 may be attached to the spindle 160 and mounted in a groove 174 in the bottom surface 166 of the upper component 162 and the upper surface 168 of the lower component 164 to limit axial movement of the spindle 160. The two components 162 and 164 are secured together by glue, or dowels (not shown) in combination with glue, after the rod 90 and keyed worm wheel 156, worm 158 and spindle 160 are mounted therein.

The spindle 160 extends out from the outer surface 64 of the fixed leg segment 62 in a direction parallel to the axis of the table top length. A knob member 176 is attached to the outer end of each spindle 160 as shown. A washer member 178, of brass or other suitable material, may be provided between the inner surface of the knob 176 and the outer surface 64 of the fixed leg segment 62 and outer surface 58 of the apron 50 or 52.

In the embodiment of the worm gear mechanism shown in FIGS. 15–17, the rod 90 does not extend up through the table top 15 as in the first embodiment. Rather, the upper end 94 of the rod 90 terminates in a blind bore 180 in the bottom surface 44 of the main member 32 of the table top 15. The bearing surface in the form of the metallic washer member 102 is provided in the counterbore 104 in the bottom surface 44 of the main member 32 of the table top 15, coaxial with the rod 90, as in the case of the first embodiment. A second bearing surface in the form of a metallic washer member 182 is provided in the counterbore 108 in the upper end of the fixed leg segment 62. The pin member 106, which extends through the rod 90, is contained between the washer member 102 in the bottom surface 44 of the table top 15 and the washer member 182 in the counterbore 180 in the upper end surface of the fixed leg segment 62.

With the arrangement of the embodiment shown in FIGS. 15–17, when it is desired to remove a removable leg segment 16, 18, 20, 22 or 24, the knobs 176 at the side of the table 10 may be rotated. This rotates the spindle 160 and worm 158, which in turns rotates the worm wheel 156 and attached rod 90 about the vertical axis of the rod 90. The rod 90 turns in the threaded portion 96 of the main leg segment 74, causing the rod 90 to move upwardly. As the rod 90 is axially coupled to the table top 15 and fixed leg segment 62 by virtue of the pin 106 being contained between the washer members 102 and 182, the table top 15 and fixed leg segment 62 will move upwardly along with the rod 90, separating the fixed leg segment 62 from the main leg segment 74. This provides the axial spacing for the removable leg segments 16, 18, 20, 22 and 24 to be separated from each other so that one or more segment may be removed if it is desired to lower the height of the table top 15. If it is desired to add one or more removable leg segments 16, 18, 20, 22 or 24, to raise the height of the table top 15, the knobs 176 must be rotated a sufficient amount to raise the table top 15 and fixed leg segments 62 relative to the main leg segments 74 a sufficient distance to provide a space for the insertion of the segment or segments. After the appropriate removable leg segments 16, 18, 20, 22 or 24 have been removed or added, the knobs 176 at the side of the table 10 may be rotated in the opposite direction to cause the worm 158 to rotate the worm wheel 156 and rod 90 in the opposite direction. This causes the rod 90 to thread itself into the threaded portion 96 of the main leg segment 74 and thus move downward, drawing the table top 15 and fixed leg segment 62 toward the main leg segment 74 and clamping the removable leg segments 16, 18, 20, 22 and/or 24 therebetween into tight engagement with each other.

Although the invention has been described above with reference to specific embodiments thereof, it is apparent that many changes, modifications, and variations can be made without departing from the concept disclosed herein. Accordingly, it is intended to embrace all such changes, modifications, and variations that fall within the scope of the appended claims.

What is claimed is:

1. An adjustable height table comprising:

a. a table top having an upper work surface;

b. at least one leg supporting said table top, said leg including a main leg segment;

c. at least one removable leg segment for insertion between said main leg segment and said table top; and d. a connection between said table top and said main leg segment to raise and lower said table top relative to said main leg segment and to clamp said removable leg segment between said table top and said main leg segment, said removable leg segment and said main leg segment presenting the profile of a continuous one-piece leg when said table top is clamped thereto, said connection including a rod member between said table top and said main leg segment, each removable leg segment having a bore therethrough and a cutout extending inwardly from its outer surface into communication with said bore so said removable leg segment can be inserted about said rod member.

2. The adjustable height table of claim 1 wherein said rod member has a threaded portion thereon, and said connection further includes an internally threaded portion in said main leg member for receiving said threaded portion of said rod member, said rod member being connected to said table top for axial movement therewith and relative rotation thereto, and means for rotating said rod member.

3. The adjustable height table of claim 2 wherein said rod member extends through said table top, and further including a knob attached to the end of the rod member above said table top for rotating said rod member.

4. The adjustable height table of claim 2 wherein said means for rotating said rod member includes a worm wheel attached to said rod member, a worm in engagement with said worm wheel for imparting rotation to said rod member, a shaft attached to said worm extending in a horizontal plane and having an outer end opposite said worm, and a knob attached to said outer end of said shaft for turning said worm.

5. The adjustable height table of claim 2 wherein there are a plurality of removable leg segments for each leg.

6. The adjustable height table of claim 2 wherein said means for rotating said rod member includes a shaft extending perpendicular to said rod member and having an inner and outer portion, means attached to said outer portion of said shaft to rotate said shaft, and a gear arrangement connecting said inner portion of said shaft to said rod member for causing rotation of said rod member about its axis upon rotation of said shaft about its axis.

7. The adjustable height table of claim 2 wherein each said removable leg segment has an alignment means for positioning said removable leg segment in proper horizontal position with said main leg segment and said table top.

8. The adjustable height table of claim 2 wherein each removable leg segment includes an upper and lower surface, said alignment means including a pin in one of said upper or lower surfaces and in one of said main leg segment or in a bottom surface of said table top, and a mating bore in the other surface of each removable leg segment and in the other of said main leg segment or said bottom surface of said table top, said pins and bores being in axial alignment.

9. The adjustable height table of claim 2 wherein each removable leg segment includes an upper and lower surface, said alignment means including a tongue member extending from one of said upper or lower surfaces of each said removable leg segment and one of said main leg segment or a bottom surface of said table top, and a mating groove in the other of said upper or lower surface of each removable leg segment and the other of said fixed leg segment or bottom surface of said table top.

10. The adjustable height table of claim 2 further including a holder for holding said removable leg segments with said table when said removable leg segments are not in use.

11. The adjustable height table of claim 10 wherein said table top has a front and rear surface defining the front and rear of said table and further includes an apron adjacent each side of the table extending downward from the table top and extending at least partially along the front and rear of the table top, and said holder includes a supporting bar attached to said apron and extending transverse of the length of the table top and spaced from the underside thereof a distance sufficient to permit a removable leg segment to be mounted thereon.

12. The adjustable height table of claim 10, wherein said table top has a front and rear surface defining the front and rear of the table, and said holder includes at least one compartment positioned below said table top adjacent the side of the table top, said compartment having at least one opening facing the front or rear of the table.

13. The adjustable height table of claim 12 wherein said compartment includes a door covering said opening, and said table includes an apron adjacent each side of the table extending downward from the table top and extending at least partially along the front and rear of the table top, said door forming part of said apron which extends along the front or rear of said table.

14. An adjustable height table comprising a. a table top having an upper work surface and a bottom surface;

b. at least two legs supporting said table top and spaced apart from each other, each leg including a main leg segment;

c. at least one removable leg segment for insertion between each said main leg segment and said table top; and d. a connection between said table top and each said main leg portion to raise and lower said table top relative to said main leg segment and to clamp said removable leg segment between said table top and said main leg segment, each said removable leg segment and said main leg segment of each leg presenting the profile of a continuous one-piece leg when said table top is clamped thereto, said connection including a rod member between said table top and said main leg segment, each removable leg segment having a bore therethrough and a cutout extending inwardly from its outer surface into communication with said bore so said removable leg segment can be inserted about said rod member.

15. An adjustable height table comprising a. a table top having an upper work surface and a bottom surface;

b. at least two legs supporting said table top and spaced apart from each other, each leg including a main leg segment having a bore extending axially at least partially therethrough from the upper end thereof, c. an internally threaded portion in said main leg segment coaxial with said bore, d. a rod extending into said bore of said main leg segment and having a threaded portion in threaded engagement with said internally threaded portion, said rod having an end extending from said main leg segment and attached to said table top for axial movement therewith and relative rotation thereto, e. at least one removable leg segment associated with each leg for insertion between each said main leg segment and said table top, and f. means for rotating said rod relative to said table top to cause the rod to move axially upward and downward in said main leg segment to raise the table top relative to said main leg segment to remove a removable leg segment and to move the table top toward the main leg segment to clamp a removable leg segment between said table top and said main leg segment, each said associated removable leg segment and said main leg segment of each leg presenting the profile of a continuous one-piece leg when said table top is clamped thereto.

16. The adjustable height table of claim 15 wherein each removable leg segment has a bore therethrough and a cutout extending inwardly from its outer surface into communication with said bore so said removable leg segment can be inserted about said rod.

17. The adjustable height table of claim 15 wherein there are a plurality of removable leg segments for each leg.

18. The adjustable height table of claim 15 further including a cross bar extending between opposed main leg segments.

19. The adjustable height table of claim 15 further including a fixed leg segment associated with each leg and extending downward from the bottom surface of said table top and secured to said table top, said removable leg segments adapted to be clamped between said fixed leg segment and said main leg segment, said fixed leg segment and said table top having a bore therethrough coaxial with the bore in said main leg segment, said rod extending through said bores in said fixed leg segment and said table top, a knob attached to the end of said rod which extends upwardly through said table top, said rod having a pin member extending therethrough, and a bearing surface for said pin attached to said table top for vertical movement therewith, said bearing surface positioned vertically above said pin whereby upon rotation of said rod in one direction within said main leg segment, the rod will move upward and said pin will bear against said bearing surface and move said table top upward.

20. The adjustable height table of claim 19 wherein said bearing surface includes a washer member positioned against the bottom surface of said table top and said pin extends through said rod within said fixed leg segment.

21. The adjustable height table of 15 further including a fixed leg segment associated with each leg and extending downward from the bottom surface of said table top and secured to said table top, said removable leg segments adapted to be clamped between said fixed leg segment and said main leg segment, said fixed leg segment having a bore therein coaxial with said bore in said main leg segment, a worm wheel attached to said rod within said fixed leg segment, a worm in engagement with said worm wheel, a shaft attached to said worm and extending from said fixed leg segment in a horizontal plane, and a knob secured to said shaft for rotating said worm.

22. The adjustable height table of claim 21 further including a pin member extending through said rod within said fixed leg segment, a first bearing surface for said pin member having vertical movement with said table top and positioned above said pin member and a second bearing surface for said pin member having vertical movement with said table top positioned below said pin member whereby upon rotation of said rod within said main leg segment, said rod will move vertically so that said pin will bear against one of said bearing surfaces to move said table top vertically relative to said main leg segment.

23. The adjustable table of claim 15 further including a fixed leg segment associated with each leg and extending downward from the bottom surface of said table top and secured to said table top, said removable leg segments adapted to be clamped between said fixed leg segment and said main leg segment, said rod member extending into said fixed leg segment, a shaft extending perpendicular to said rod member having an outer portion extending from said fixed leg segment and an inner portion within said fix leg segment, means attached to said outer portion of said shaft to rotate said shaft, and a gear arrangement connecting said inner portion of said shaft to said rod member for causing rotation of said rod member about its axis upon rotation of said shaft about its axis.

* * * * *